US006848224B2

(12) United States Patent
Bailey

(10) Patent No.: US 6,848,224 B2
(45) Date of Patent: Feb. 1, 2005

(54) ADJUSTABLE MASONRY ARCH FORM

(76) Inventor: Michael Eugene Bailey, 102 Georgia Manor La., Trussville, AL (US) 35173

( * ) Notice: Subject to any disclaimer, the term of this patent is extended or adjusted under 35 U.S.C. 154(b) by 0 days.

(21) Appl. No.: 10/102,035

(22) Filed: Mar. 20, 2002

(65) Prior Publication Data

US 2003/0177714 A1 Sep. 25, 2003

(51) Int. Cl.[7] ..... E04C 3/02
(52) U.S. Cl. ..... 52/204.2; 52/86; 52/89
(58) Field of Search ..... 52/85, 86, 88, 52/89, 204.2, 730.6, 731.7

(56) References Cited

U.S. PATENT DOCUMENTS

| | | | | | |
|---|---|---|---|---|---|
| 312,143 | A | * | 2/1885 | McCauley | 126/500 |
| 2,361,828 | A | * | 10/1944 | Drayer | 52/204.2 |
| 3,005,423 | A | * | 10/1961 | Longenecker | 110/335 |
| 3,008,273 | A | | 11/1961 | Widin | |
| 4,325,207 | A | | 4/1982 | Russell et al. | |
| 4,400,917 | A | | 8/1983 | Massaro et al. | |
| 4,424,652 | A | * | 1/1984 | Turner | 52/204.2 |
| 4,433,518 | A | * | 2/1984 | Rice | 52/435 |
| 5,247,769 | A | | 9/1993 | Becker | |
| 5,291,717 | A | * | 3/1994 | Turner | 52/745.07 |
| 5,321,921 | A | | 6/1994 | Holt | |
| 5,507,123 | A | | 4/1996 | Holt | |
| 5,581,959 | A | | 12/1996 | Occhipinti | |
| 5,671,583 | A | | 9/1997 | Turner | |
| 5,735,035 | A | | 4/1998 | Holt | |
| D407,831 | S | | 4/1999 | Gifford | |
| 6,094,877 | A | * | 8/2000 | White | 52/247 |
| 6,119,420 | A | * | 9/2000 | Koenig et al. | 52/255 |

OTHER PUBLICATIONS

Digital photographs of device in use before Applicant's priority date (3 photographs).

* cited by examiner

*Primary Examiner*—Brian E. Glessner
(74) *Attorney, Agent, or Firm*—Bradley, Arant, Rose & White

(57) ABSTRACT

An adjustable masonry arch form is disclosed. The adjustable masonry arch form has a planar base section to support the masonry elements which will form the masonry arch, and a plurality of attachment elements secured to the planar base for securing the form to a structure. The adjustable masonry arch form is constructed from material rigid enough to support the masonry elements, but flexible enough to be bent to conform to any given arched construction without unwanted buckling of the form. The masonry elements which form the masonry arch are placed directly on the planar base of the form in the desired configuration and secured in the masonry arch by mortar. The form is left in position permanently, obviating the need to build a temporary arch support saving time and expense and obviating waste of materials.

19 Claims, 3 Drawing Sheets

52
22
12
16
58
50

ADJUSTABLE MASONRY ARCH FORM

FIELD OF THE DISCLOSURE

The present disclosure relates generally to an improved device for use in masonry applications. In particular, the present disclosure relates to an adjustable masonry arch form to support masonry elements in an arched construction.

BACKGROUND

In building projects, such as residential homes and commercial buildings, ornamental masonry elements are often placed over/around various structural features for aesthetic purposes. This is especially common around windows and doors. As used in this specification, masonry elements/masonry shall mean stone, brick, or other earthen materials used for construction purposes, generally using mortar as a bond. The presence of masonry accents in a residential home can greatly increase its resale value, and provides the homeowner with the desired aesthetic look and feel he/she is seeking.

The process of installing masonry elements over and/or around a desired structural feature varies depending on the shape of the desired structural feature. In some cases, the top of the structural feature will be horizontal (horizontal construction). In other cases, the top of desired structural feature will have an arched component (arched construction). By arched component it is meant any structural feature that has a change in elevation at any point intermediate between the ends of the structural feature. In the case of horizontal constructions, the standard practice is to lay the masonry elements across a supporting horizontal beam (commonly referred to as a lintel) set in place over the structural feature, for example a window. The lintel can be made from steel, wood, or reinforced concrete, depending on the size of opening and weight to be supported. The lintel commonly rests on the masonry that is installed up the sides of the window. The masonry elements are then installed on the horizontal face of the lintel in the configuration desired. The lintel remains a part of horizontal construction above the window or door.

In arched constructions, this practice cannot be employed. As stated above, the materials that lintels are constructed from (steel, wood, or reinforced concrete) cannot be easily adapted to fit the contours of an arched construction. Therefore, other methods must be used to support the masonry elements that form a masonry arch in an arched construction. Several methods are typically used to support the masonry elements that form a masonry arch. The first method is to build an arch form, which is commonly constructed from plywood and dimensional lumber. The arch form must be constructed to exactly fit the contours of the masonry arch to be constructed, and is supported in place with wooden legs. The arch provides the surface to support the masonry elements forming the masonry arch while the mortar hardens. Once the mortar hardens, the arch form is removed and discarded. In addition, the mortar must generally be scratched or chiseled to conform to the appearance of the mortar forming the remainder of the structure.

The second method is to drive nails or similar items into the outer edge of the exterior of a structure to support the masonry elements that forms the masonry arch. In order to provide sufficient support for the masonry elements, the nails must be placed close together, which necessitates the use of a large number of nails. Once the mortar hardens, the nails are removed. The removal of the nails leaves multiple holes in the exterior molding that must be repaired by filling the holes and painting the surface The third method is to support a section of lumber horizontal to the bottom edge of the masonry arch to be constructed. Once the section of lumber is in place, bricks or other material are stacked on the horizontal section of lumber to support the masonry elements that form the masonry arch. As is obvious, the bricks are placed in a jigsaw fashion until the proper height is reached to support each section of the masonry elements. This requires that the bricks be cut into smaller pieces to support various sections of the arch. In addition to being very time consuming, such a method leads to many bricks being wasted. In addition, the bricks can fall easily requiring the temporary form be reconstructed. Once the mortar hardens, the bricks and the horizontal section of lumber are removed.

A fourth method to support the masonry elements that form a masonry arch is to use prefabricated arch supports. These arch supports are shipped with the arch structure preformed. However, these items must be specially ordered since the configuration of masonry arches varies from application to application, making a "standard" prefabricated arch form impractical. As a result, these prefabricated supports are expensive. In addition, the prefabricated supports create other problems. Since the supports are prefabricated in the form of an arch, they are bulky to ship and store, further increasing their cost. In addition, these preformed supports are more susceptible to damage during shipping and storage. As a result, if the units are damaged, construction may be delayed while replacement supports are obtained.

Each of the methods discussed above suffer from several shortcomings. In general, the methods are tedious and time consuming to implement. As a result, the cost of the final construction can be increased dramatically. In addition, the arched constructions lack the strength of the horizontal constructions because of the lack of a solid lintel. In most cases, much of the weight of the masonry arch in supported directly by the structure over which the arch is installed, such as a door or window. This additional weight can cause damage. Therefore, what is needed is a device that will allow a masonry arch to be installed conveniently and economically. The device should be simple to use and not require the creation of complicated temporary structures that are expensive and time consuming to create. In addition, the device should eliminate the need to make costly repairs to the exterior of the structure caused by the installation process.

SUMMARY

The adjustable masonry arch form of the present disclosure is an improvement over current devices available for installing masonry arches. The adjustable masonry arch form comprises a planar base section to support the masonry elements which will comprise the masonry arch, and a plurality of attachment means secured to the planar base for securing the form to a structure. In the embodiment illustrated, the attachment means is shown as a rounded flange. The adjustable masonry arch form is constructed from material rigid enough to support the masonry elements, but flexible enough to be bent to conform to any given arched construction. The adjustable masonry arch form is secured to the exterior of a structure by a securing means, such as screws, nails or staples. The masonry elements which will comprise the masonry arch are placed directly on the planar base of the form in the desired configuration and secured in the masonry arch by mortar. The form is left in position permanently, obviating the need to build a temporary arch support saving time and expense and obviating waste of materials, while providing additional strength to the arched construction. In addition, there is no repair required to the exterior surface of the structure.

Therefore, it is an object of the disclosure to provide an adjustable masonry arch form that is capable of being installed in any given arched construction at a construction site without the need to create or special order individually configured arch forms. It is another object of the disclosure to provide an adjustable masonry arch form that is permanently installed in an arched construction, thereby obviating the time consuming and wasteful practice of creating temporary forms, and which provide additional strength to the masonry arch. An additional object of the disclosure is to provide an adjustable masonry arch form such that the planar base and/or attachment means will not be deformed as the ach form is bent to conform to the contours of an arched construction. Yet another object of the disclosure to provide an adjustable masonry arch form that is economical to produce and simple to install, decreasing the overall cost of the finished arched construction. It is a further object of the disclosure to provide an adjustable masonry arch form that can be easily shipped, transported and stored, thereby minimizing the risk of damaging the form and avoiding costly construction delays caused by ordering replacement arch forms. It is also an object of the disclosure to provide an adjustable masonry arch form that will prevent damage to the structural features over which masonry arches are installed. Additional objects and advantages will become apparent through the drawings and descriptions that follow.

DETAILED DESCRIPTION

Figure 1:
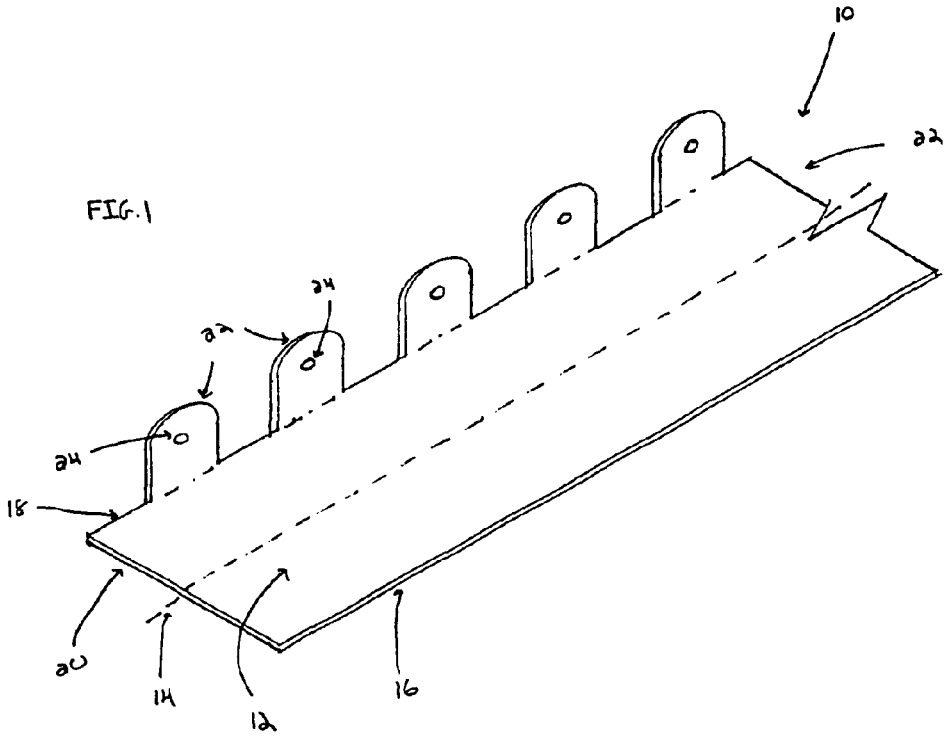
FIG. 1 is a perspective view of one embodiment of the adjustable masonry arch of the present disclosure.
Figure 2:
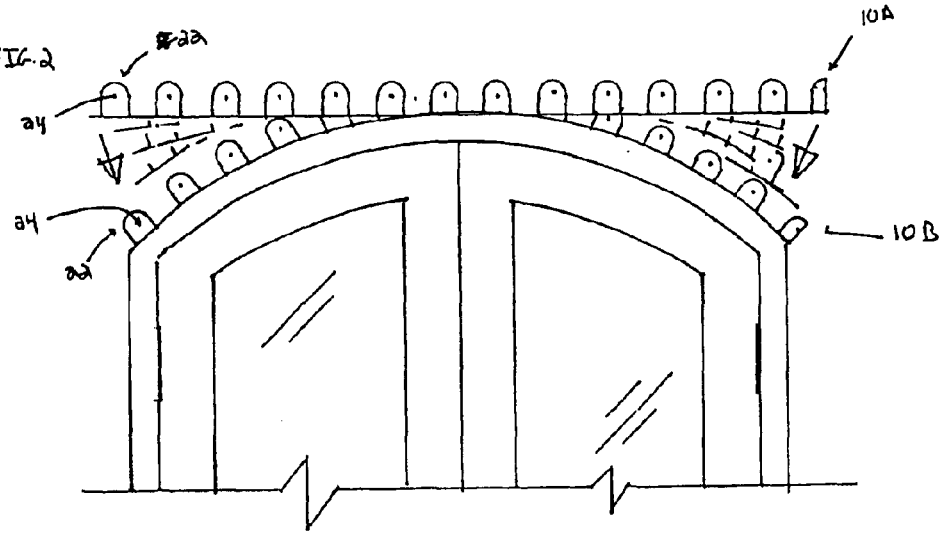
FIG. 2 is a perspective view of the adjustable masonry arch form of FIG. 1 being installed over an arched door.
Figure 3:
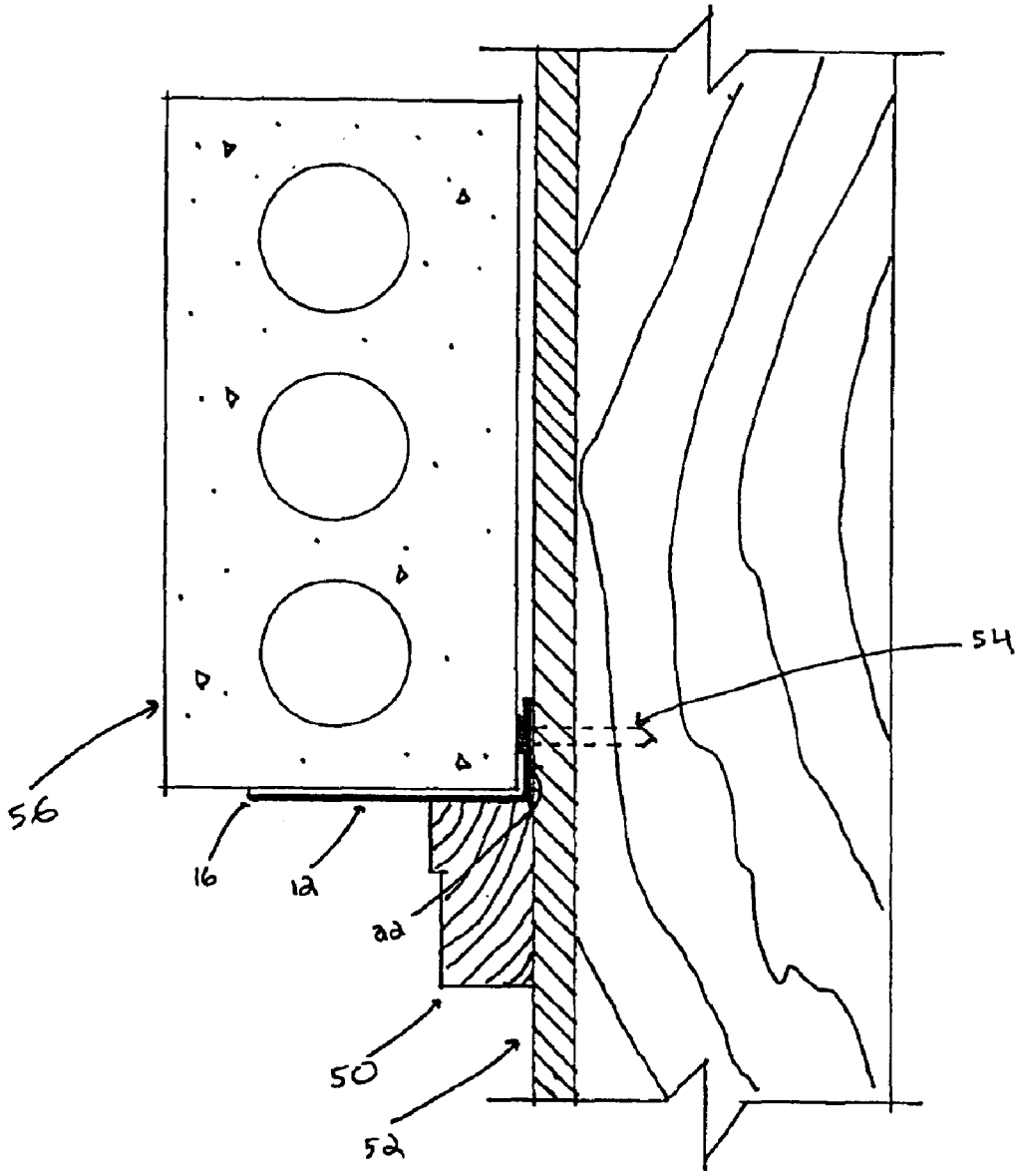
FIG. 3 is a side, cutaway view of the adjustable masonry arch form of FIG. 1 as installed in an arched construction.

The adjustable masonry arch form 10 is illustrated in FIGS. 1–4, where like numbers in the figures refer to like elements. As illustrated in FIG. 1, the form 10 is composed of a planar section 12. The planar section 12 comprises longitudinal axis 14, a front side 16 and a rear side 18 parallel to the axis 14, and two ends 20 and 22. The width of the planar section 12 is sufficient to support the masonry to be incorporated into the masonry arch. While the width can be varied as determined by individual applications as can be determined by one of ordinary skill in the art, in one embodiment the planar section 12 is 3 inches wide. For aesthetic purposes, it is desired that the width of the planar section 3 be slightly less than the width of the masonry elements to be incorporated into the masonry arch (as illustrated in FIG. 3). The form 10 can be manufactured in any length desired and can be cut to fit a given installation at the job site. A plurality of attachment means are secured to the rear side 18. The attachment means are generally perpendicular to the axis 14 of the planar base 12. In the embodiment illustrated, the attachment means are shown as flanges 22. The flanges 22 may be of any desired configuration, but in the embodiment shown the flanges 22 are shown with rounded edges for ease of installation and to remove sharp edges which may cause injury to the installer. In one embodiment the flanges 22 each have an opening 24 for receiving a means to secure the form 10 to a structure. It is preferred that the opening 24 be centered on flange 22 for ease of use, but opening 24 may be placed anywhere on flange 22.

The flanges 22 are placed at intervals along the planar section 12. In one embodiment, the flanges 22 are placed 1 inch apart along the length of the form. By spacing the flanges 22 apart from one another, the form 10 can be bent to conform to the contours of a desired arched construction without deforming planar base 12 and/or the attachment means, in this case flanges 22. In prior devices, when the form is made to conform to the contours of an arched construction, the device would be deformed at undesirable locations in response to the bending force applied. This deformation is often referred to as splaying or buckling. As a result of the splaying or buckling of prior devices, the masonry element could not be installed in a uniform and aesthetically pleasing manner. The spacing apart of flanges 22 along the rear side 18 also allows the form 10 to be bent without requiring excessive bending force to be applied, allowing the form 10 to be installed at a jobsite with no special equipment required. The width of each individual flange 22 is such that the flange 22 can receive a securing means to secure the form 10 to a structure, but narrow enough so that the flange 22 will not interfere with the flexibility of the form 10. In one embodiment the width of the individual flange is 1 inch. The above spacing distances and flange widths are given as examples only, and other spacing distances and flange widths may be used as determined by one of ordinary skill in the art and should be considered within the scope of this disclosure.

The device 10 is made of a material that is rigid enough to support the masonry elements comprising the masonry arch, yet flexible enough to be bent to conform to the contours of an arched construction, typically over a window or door. A preferred material for construction of form 10 is 14 gauge steel, however, other materials may be used, including but not limited to high strength plastic or composite materials. Since the form 10 is flexible, it can be bent from its horizontal configuration to conform to the contours of an arched construction and secured in place at the site of use (illustrated in FIG. 2).

The form 10 can be made by a variety of methods, the following being provided as example only. The form 10 may be formed from a single piece of material, in this example 14 gauge steel. The single piece of steel may be stamp or die cut to form the individual attachment means, in this case flanges 22, at the desired intervals along the newly formed rear side 18. Once the flanges 22 are formed, the flanges 22 can be bent upward such that they are generally perpendicular to axis 14 of the planar base 12. The flanges 22 are illustrated with rounded edges for ease of installation and to minimize sharp edges, however, any configuration of flanges 22 may be produced. Alternatively, individual attachment means, in this case flanges 22, may be produced individually and secured to the rear side 18 of planar base 12 by any convenient means, such as by welding. The form 10 is produced in a horizontal configuration. The benefits of making the form 10 in the horizontal configuration include ease of transporting, shipping and storing the form 10 as compared to prefabricated forms. Since the arch is not prefabricated, much less space is required to ship, transport and store the form 10. In addition, because the form 10 is made in the horizontal configuration out of a sturdy material, the form 10 is less likely to be damaged during shipping, transport and storage, thereby eliminating possible delay in construction caused by obtaining replacement forms. Furthermore, since the form 10 can be bent to conform to any arched construction, there is no need to maintain a supply of prefabricated arch forms for use on different types of arched constructions, greatly decreasing the cost of storage and maintaining the proper inventory.

Figure 4:
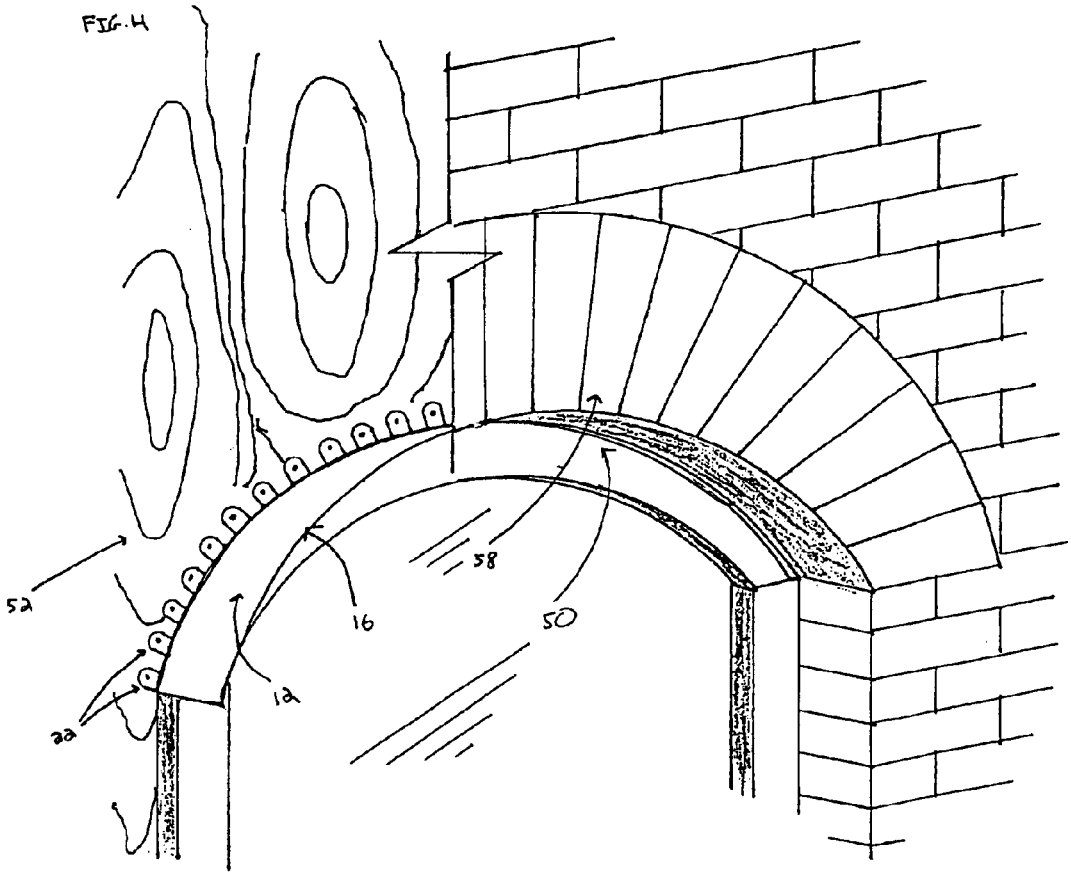
FIG. 4 is a front, partial cutaway view of the adjustable masonry arch form of FIG. 1 installed over an arched window.

As illustrated in FIGS. 2–4, the form 10 is placed atop the molding of an arched construction over which the masonry arch is to be installed, illustrated best in FIG. 3 as molding 50. The form 10 is then bent into shape over the molding 50 to conform to the shape of the molding 50 and provide a flat surface on which to place the masonry elements which will comprise the masonry arch. FIG. 2 shows the form 10 in its horizontal configuration (10A) and after it is bent (10B) to conform to the contours of the arched construction. The form 10 can be manipulated to fit any arched construction by simply cutting the form 10 to the desired length and bending the form 10 to conform to the contours of the desired arched construction. It is preferred that the form 10 be cut to the desired length before being bent to conform to the desired arched construction. Once the form is in place, the form 10 is secured to the exterior sheathing of a structure, illustrated as sheathing 52 in FIGS. 3 and 4, by a securing means. FIG. 3 shows the form 10 being secured to sheathing 50 by a nail 54, however, other securing means, such as screws, staples, or bolts may be employed. Once the form 10 is secured, the flanges 22 may be covered with the appropriate waterproof construction paper to prevent seepage of water behind the form 10.

As discussed above, there are several alternate methods of supporting masonry elements in an arched construction. In most of these methods, the masonry elements are placed directly on the molding of the window or door over which they will be installed. In the case of installation over windows, the weight of the masonry elements stresses the window such that the panes in the window may be damaged. For example, it is not uncommon for the seal in a double-paned window to break under the weight of masonry elements, which are applied directly on the molding of the window. The use of the form 10 removes the weight of the masonry elements from the window or door, thereby preventing damage to these components, further reducing the costs of construction.

Once form 10 is secured in place, masonry elements are then placed on the planar base 12 and arranged according to the specifications for the given arched construction. While any masonry elements may be used, FIG. 3 illustrates a typical brick 56 being installed on planar base 12. FIG. 4 illustrates a vertically oriented paver 58 being installed on planar base 12. The individual masonry elements are then secured in the desired arrangement by mortar or similar material. Once the mortar hardens, the installation of the masonry arch is complete. The form 10 remains as a part of the arched installation and it is not required to remove the form 10. An additional advantage of the form 10 remaining a permanent part of the masonry arch is the form 10 provides a significant amount of strength to the masonry arch. As a result, the mortar holding the masonry arch together is less prone to crack as a result of normal settling of the structure and other factors. As a result, repair and maintenance cost may be significantly less in arched constructions having the additional strength afforded by form 10, than in arched constructions without such additional strength. As discussed above, the width of the planar base 12 is les than the width of the masonry elements to be installed on planar base 12 such that planar base 12 is essentially invisible in the finished installation.

The above has described several embodiments of the adjustable masonry arch form in detail so that the form and its principles of operation may be understood. The above discussion should not be interpreted to exclude additional embodiments of the form. With respect to the above description, it should be considered that the optimal dimensional relationships for the various parts of the form, including variations in size, materials, shape, form, function and manner of operation, assembly and use, are readily apparent to one of ordinary skill in the art, and all equivalent relationships to those described above and illustrated in the figures are intended to be encompassed by the present disclosure. Therefore, the foregoing is considered illustrative only, and should not be understood to limit the scope of the disclosure to the exact construction and operation discussed and illustrated.

What is claimed:

1. An adjustable masonry arch form for supporting an arched construction in a building, said arched construction comprising a plurality of masonry elements each of which having an outer edge, the form comprising a planar base having a first side and a second side and a width so dimensioned to receive and support said masonry elements and a plurality of attachment means secured to the first side of the planar base, said attachment means securing the masonry arch form to an exterior surface of said building and said planar base receiving and supporting said masonry elements such that the second side of the planar base does not extend beyond the outer edge of said masonry elements and remaining as a permanent part of said arched construction, and the adjustable masonry arch form being manufactured from a material sturdy enough to support the masonry elements, but flexible enough to conform to the contours of the arched construction.

2. The adjustable masonry arch form of claim 1 where the form is capable of being bent to conform to the contours of the arched construction at a construction site without deforming the planar base and the attachment means.

3. The adjustable masonry arch form of claim 2 where the attachment means are spaced apart along the planar base.

4. The adjustable masonry arch form of claim 3 where the attachment means are spaced approximately 1 inch apart.

5. The adjustable masonry arch form of claim 3 where the attachment means farina a generally perpendicular angle with the planar base.

6. The adjustable masonry arch form of claim 5 where the attachment means further comprises an opening therein for receiving a securing means to secure the form to the exterior of said building.

7. The adjustable masonry arch form of claim 6 where the attachment moans are spaced approximately 1 inch apart.

8. The adjustable masonry arch form of claim 2 where the attachment means are a plurality of flanges.

9. The adjustable masonry arch form of claim 8 where the flanges are approximately 1 inch in width.

10. The adjustable masonry arch form of claim 9 where the flanges are spaced approximately 1 inch apart.

11. The adjustable masonry arch form of claim 10 where the flanges further comprise an opening therein for receiving a securing means to secure the form to the exterior of said building.

12. The adjustable masonry arch form of claim 9 where the width of the planar base is approximately 3 inches.

13. The adjustable masonry arch form of claim 7 where the width of the planar base is approximately 3 inches.

14. The adjustable masonry arch form of clam 11 where the width of the planar base is approximately 3 inches.

15. The adjustable masonry arch form of claim 1 where the material is selected from the group consisting of a composite material, high strength plastic and steel.

16. The adjustable masonry arch form of claim 15 where the material is 14 gauge steel.

17. The adjustable masonry arch form of claim 12 where the form is manufactured from 14 gauge steel.

18. The adjustable masonry arch form of claim 13 where the form is manufactured from 14 gauge steel.

19. The adjustable masonry arch form of claim 14 where the form is manufactured from 14 gauge steel.

* * * * *